US005829788A

United States Patent [19]

Jackson

[11] Patent Number: 5,829,788

[45] Date of Patent: Nov. 3, 1998

[54] LABEL WITH HANGING HANDLE

[75] Inventor: Merrill Jay Jackson, Palmdale, Calif.

[73] Assignee: Laurence-Underwood Company Co., Inc, Chatsworth, Calif.

[21] Appl. No.: 846,596

[22] Filed: Apr. 30, 1997

[51] Int. Cl.[6] ..... B42D 15/00

[52] U.S. Cl. ..... 283/81; 283/79; 283/80; 40/299; 40/662; 40/907

[58] Field of Search ..... 40/299, 310, 662, 40/907, 331; 283/81, 79, 80

[56] References Cited

U.S. PATENT DOCUMENTS

| | | | |
|---|---|---|---|
| 2,135,236 | 11/1938 | Koppelman . | |
| 2,362,523 | 11/1944 | Armstrong, Jr. et al. . | |
| 2,635,604 | 4/1953 | Fredrickson . | |
| 3,231,919 | 2/1966 | MacDonald . | |
| 3,423,861 | 1/1969 | Forsyth | 40/310 |
| 3,635,367 | 1/1972 | Morita et al. . | |
| 3,744,658 | 7/1973 | Fujio . | |
| 3,893,495 | 7/1975 | Standifer . | |
| 4,208,819 | 6/1980 | Jones et al. | 40/310 |
| 4,460,143 | 7/1984 | Ohama . | |
| 4,526,404 | 7/1985 | Vasquez . | |
| 4,796,937 | 1/1989 | Andrea . | |
| 4,832,301 | 5/1989 | Hachioji et al. . | |
| 4,948,000 | 8/1990 | Grabenkort . | |
| 5,135,125 | 8/1992 | Andel et al. . | |
| 5,167,086 | 12/1992 | Fast | 40/299 |
| 5,490,658 | 2/1996 | Coward et al. . | |

FOREIGN PATENT DOCUMENTS

| | | |
|---|---|---|
| 0140420 | 5/1985 | European Pat. Off. . |
| 3631021 | 3/1988 | Germany . |

OTHER PUBLICATIONS

The Avery Dennison Corporation advertisement for the hanging labels (Marked #1).

The Avery Dennison Corporation advertisement for the hanging labels (Marked #2).

The Avery Dennison Corporation instruction material for the hanging labels (marked #3).

Tapecon hanging labels (Marked #4).

*Primary Examiner*—Daniel W. Howell
*Assistant Examiner*—Adesh Bhargava
*Attorney, Agent, or Firm*—Colin P. Abrahams

[57] ABSTRACT

A label comprises an upper surface, a lower surface having an adhesive layer thereon to permit adherence of the label to a surface, and a handle portion. The handle has thereon a substantially centrally located pull tab and a series of cuts which permit unfolding of the handle portion into a hanging strip. The cuts are arranged such that the handle portion unfolds along the cuts when the pull tab is pulled. The handle portion has a deadening layer on the adhesive layer thereof.

17 Claims, 4 Drawing Sheets

FIG. 6
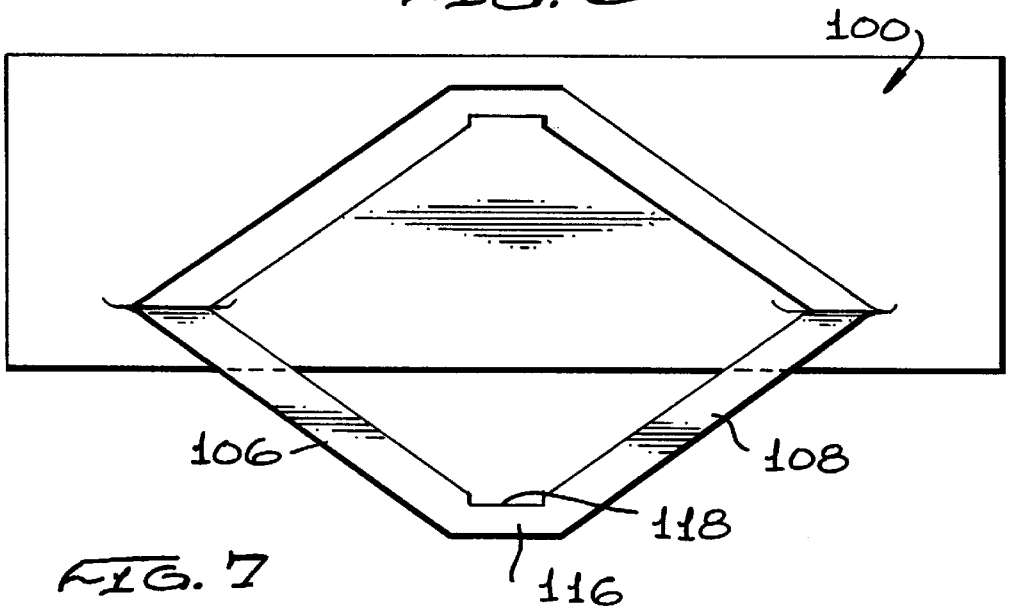
FIG. 7
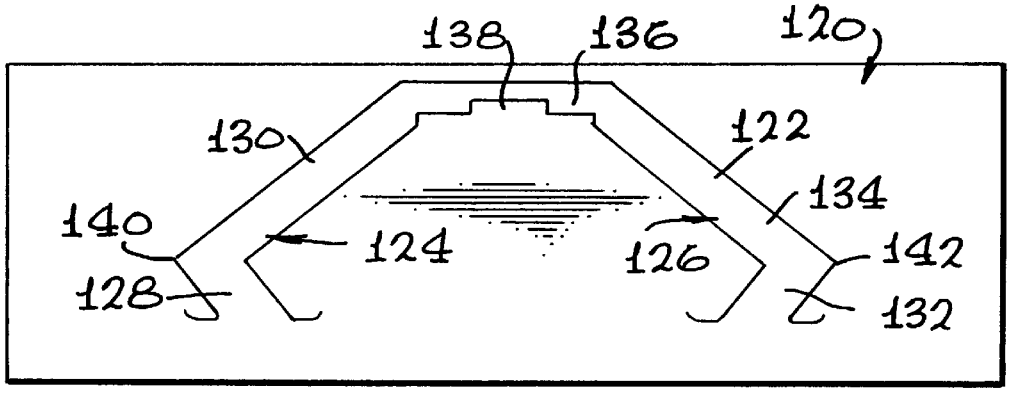
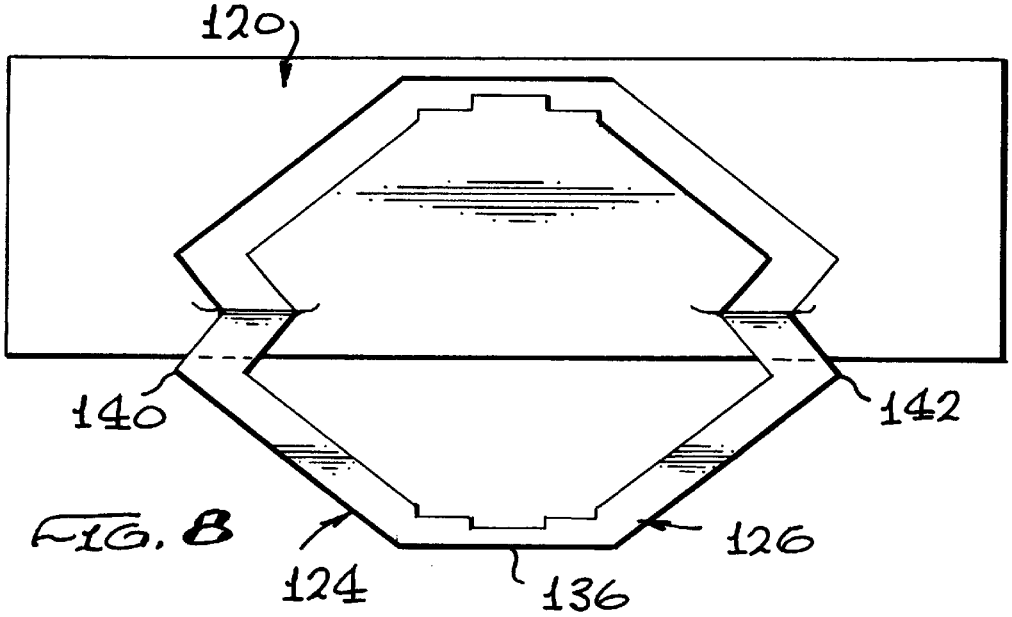
FIG. 8

LABEL WITH HANGING HANDLE

FIELD AND BACKGROUND OF THE INVENTION

This invention relates to labels having a hanging handle, and particularly such labels for use on bottles used in the health industry.

The health industry commonly uses containers and receptacles, such as glass bottles, for pharmaceutical compositions and products to be administered to patients. In one particular application, such receptacles may contain liquid which is to be conveyed to the body through tubes and introduced into the body intravenously.

The receptacle may therefore comprise a bottle or bag containing the pharmaceutical composition, and a specialized outlet for receiving a tube or the like. The tube is connected at one end to the receptacle, and at its other end through a needle or other apparatus to the body to permit the pharmaceutical composition to flow from the receptacle to the body intravenously.

In many situations, the receptacle is suspended from a bracket of some type on a stand which is adjacent the patient. Most typically, the bracket on a stand may be next to a hospital bed or chair. The bottle is suspended from the bracket so that the pharmaceutical fluids contained therein gravitate towards the outlet and are thereafter introduced into the tube for conveyance to the patient intravenously.

It is important that the container or receptacle, such as the glass bottle, be suspended so that its outlet or opening is at the lowermost point to ensure that all of the fluids contained in the receptacle can be allowed to pass through the opening thereof.

The present invention relates to a label having a hanging handle for application on to the bottle, the label allowing the bottle to be suspended in an inverted position, after an appropriate peel-off handle section has been partially removed from the label. The label of the invention facilitates proper inversion of the bottle so that it is generally centered in the best position to permit outflow of all pharmaceutical compositions, and to maintain it in that position notwithstanding minor bumps or knocks which the bottle may receive.

DESCRIPTION OF RELATED ART

U.S. Pat. No. 5,135,125 (Andel) describes a basic hanging label having a hanging ring for suspending a bottle from an intravenous stand. The label has a series of layers, including two pressure sensitive adhesive layers. A pattern of cuts penetrate certain of these layers, the cuts being formed in a hanging ring configuration. A release coating exists between the hanging ring and the adhesive layer to permit the handle to be peeled from the remaining portion of the label. Andel also describes a hanging label with the cuts forming an annular portion.

U.S. Pat. No. 5,490,658 (Coward) also describes label hangers for intravenous bottles. A number of such labels are shown in the Coward patent, including pairs of hang tabs on the label with ties having eyelets which are threaded onto a hook. Coward further describes a label including a strip cut in a particular configuration, such that when the strip is removed from the remainder of the label, a label hanger for the intravenous bottle is produced.

Various other constructions of labels are also known, most typically those having an annular or rounded cut out portion which can be peeled off the label, so that the receptacle or glass bottle can be inverted using the peeled off label.

SUMMARY OF THE INVENTION

According to one aspect of the invention, there is provided a label comprising an upper surface; a lower surface having an adhesive layer thereon to permit adherence of the label to a surface; a handle portion having thereon a substantially centrally located pull tab and a series of cuts which permit unfolding of the handle portion into a hanging strip, the cuts being arranged such that the handle portion unfolds along the cuts when the pull tab is pulled, the handle portion having a deadening layer on the adhesive layer thereof.

Preferably, the cuts define a top strip near an upper edge of the label, a pair of middle strips extending outwardly from a substantially central portion of the handle portion, and a pair of lower strips extending outwardly from the substantially central portion of the handle portion. The top strip and middle strip may be separated by an upper transverse cut, the middle strip and lower strip conveniently being separated by a pair of median cuts therebetween, and the lower strip being separated from the remainder of the label by a lower transverse cut.

Preferably, the upper and lower transverse cuts terminate at ends which are curved, and an end of each medium cut terminating within the handle portion has a curved end. A plurality of ties may be provided along one or more of the cuts, the ties being easily ruptured upon unfolding of the handle portion and an information portion, adjacent the handle portion, upon which printed or written information is entered, may also be provided.

Preferably, the information portion includes a peel-off section, the peel-off section being defined by vertical and horizontal cuts on the information portion, the label further comprising a release layer on the face layer of the peel-off section to permit easy removal thereof. A piggyback label on an information portion of the label may be provided, the piggyback label being easily removable from the information portion of the label. The label may further comprise a liner upon which the label is mounted, the label including an adhesive layer thereof on the lower surface being removable from the liner for application, in use, to a container or receptacle.

According to a further aspect of the invention, there is provided a label comprising an upper surface, a lower surface having an adhesive layer thereon to permit adherence of the label to a surface, a handle portion having thereon a series of cuts which define a substantially V-shaped handle portion, the V-shaped handle portion being folded on the label, and movable to an unfolded position so as to define a hanging strip, the handle portion having a deadening layer on the adhesive layer. The V-shaped handle portion may have a notch at its apex, the notch being adapted to engage a holding bracket to prevent slippage of the hanging strip on said bracket.

According to yet a further aspect of the invention there is provided a process for manufacturing a label including a first base label and a piggyback label thereon, the method comprising: forming a handle portion on the base label; applying a deadening label between an adhesive on a lower surface of the base label and the handle portion to permit easy unfolding of the handle portion into a hanging strip; applying a release layer to an upper surface of the label; laminating a piggyback label on the release coating; cutting through the piggyback label to provide such a piggyback label of desired shape; and removing those portions of the piggyback label outside the cut so as to provide a small piggyback label thereon.

BRIEF DESCRIPTION OF THE DRAWINGS

FIG. 6 is a plan view of the hanging label shown in FIG. 5 with the handle peeled back from the remainder of the label;

FIG. 7 is a plan view of a third embodiment of a label of the invention showing a "dog leg" shape handle with a notch therein;

FIG. 8 is a plan view of the hanging label shown in FIG. 7, with the handle peeled back from the remainder of the label;

DETAILED DESCRIPTION OF THE PREFERRED EMBODIMENTS

Figure 1:
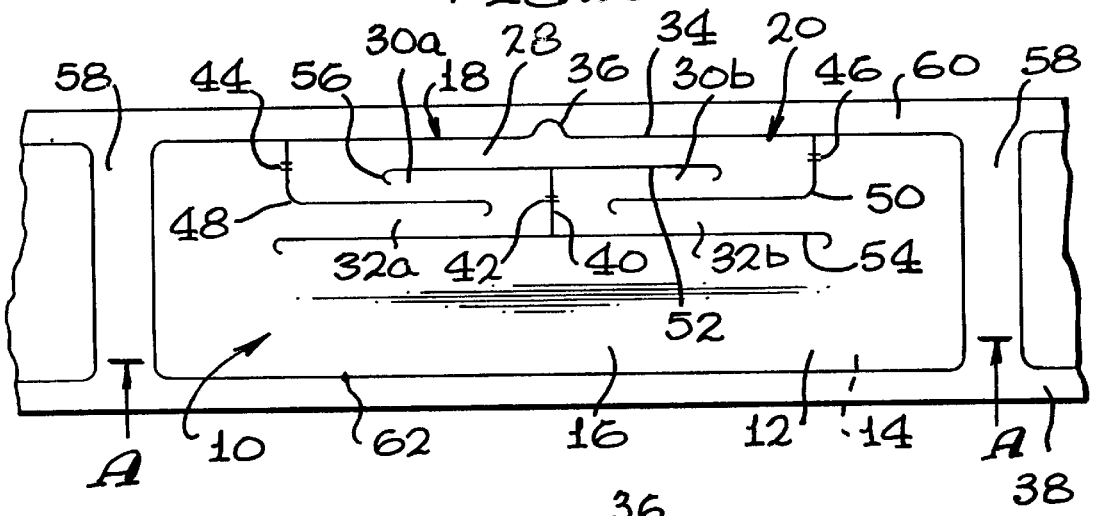
FIG. 1 is a plan view of a label of the invention, with the handle thereof in the folded position.
Figure 2:
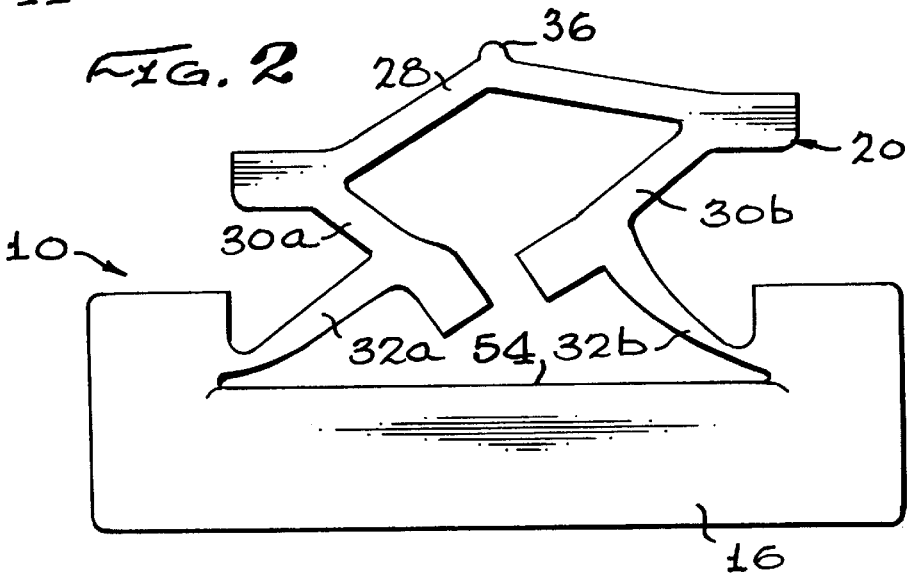
FIG. 2 is a plan view of the label shown in FIG. 1, with the handle thereof in the partially unfolded position.
Figure 3:
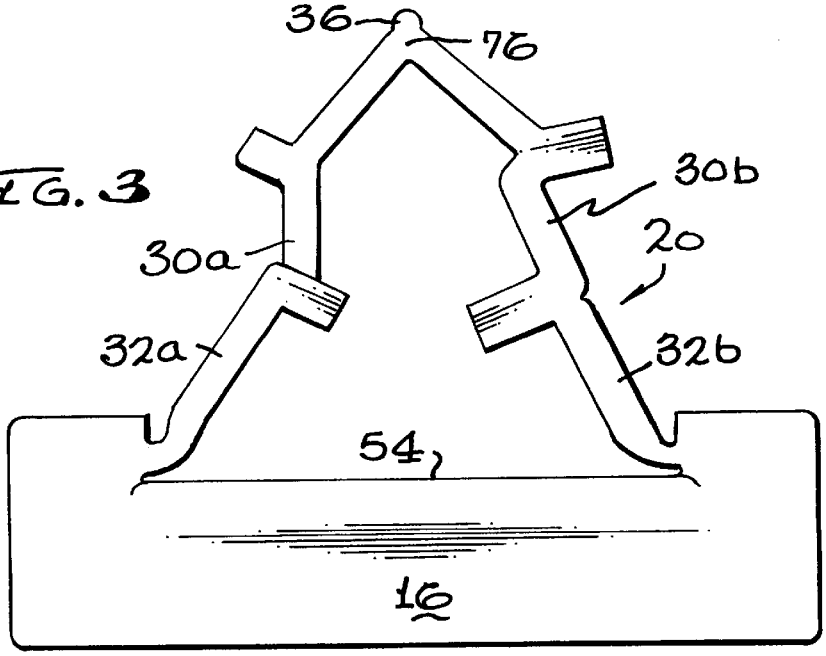
FIG. 3 is a plan view of the label shown in FIG. 1, wherein the handle thereof is completely unfolded.

With reference to FIGS. 1, 2 and 3, there is shown a label 10 having a hanging handle. The label 10 has an upper surface 12 on which can be printed or written relevant medical, health or other information, and a lower surface 14, which is an adhesive surface, and which can be applied to a bottle or other type receptacle.

The upper surface 12 generally has an information portion 16, which can contain the relevant medical information, and a handle portion 18 which can easily be unfolded, as will be described below, so as to provide a hanging strip 20 by means of which a bottle attached to the label hanger 10 can be suspended in an inverted position from a bracket 22 extending from a vertical support post 24. The information portion 16 has a relatively large uninterrupted area for such medical information. The vertical support post 24 may be mounted on wheels 26, and it may be located at an appropriate position so as to be near a patient requiring intravenous introduction of medication, nutrients, etc.

The handle portion 18 comprises the hanging strip 20 which is cut onto the label 10 in a folded position. The hanging strip 20, when in the folded position (see FIG. 1), has a top strip 28, a pair of middle strips 30*a* and 30*b*, and a pair of lower strips 32*a* and 32*b*. The top strip 28 is continuous, i.e. is unbroken or uninterrupted, and has along its upper edge 34 an outwardly extending pull tab 36 to facilitate removal of the folded hanging strip 20 from a liner or backing 38 on which the label 10 is cut. The middle strips 30*a* and 30*b*, as well as the lower strips 32*a* and 32*b*, are separated from each other by a center cut 40. The center cut 40 has a tie 42 therealong which will break easily when the hanging strip 20 is opened from the folded position, as will be discussed below. Ties 44 and 46 are located along right angle cuts 48 and 50 respectively. An upper transverse cut 52 divides the top strip 28 from the middle strips 30*a* and 30*b*, while a lower transverse cut 54 separates the lower strips 32*a* and 32*b* from the information portion 16 of the label.

It will be noted that the ends of the upper transverse cut 52, lower transverse cut 54, cut 48 and cut 50 all have curved shaped ends 56.

The label 10, with the hanging strip 20 in the folded position, is mass manufactured along a liner or backing 38. First, a liner or backing 38 with a continuous, uninterrupted single layer thereon is processed so that a plurality of labels 10 are thereafter located serially along the liner 38. The portions interadjacent each label 10 are removed, leaving a space 58 between each label 10. Upper and lower edge strips are removed to provide an upper rim 60, and a lower rim 62 along the edges of the liner 38. Thereafter, or simultaneously, the upper and lower transverse cuts 52 and 54 are introduced, together with cuts 48 and 50 and the center cut 40. As described above, all cuts leave the various ties 42, 44 and 46, which easily tear when the hanging strip 20 is unfolded for use, as described below.

In use, a label 10 is peeled off the liner 38 and placed on a container, such as a glass bottle 64. The label 10 is specially designed for glass bottles having a particular circumference. Generally, the length of both of lower strips 32*a* and 32*b* approximate about half the circumference of the bottle. This is best shown in FIG. 2 with the hanging strip 20 in the unfolded position. Thus, when the hanging strip 20 is unfolded, each lower strip 32*a* and 32*b* will be at approximately opposite ends of the glass bottle.

Figure 4:
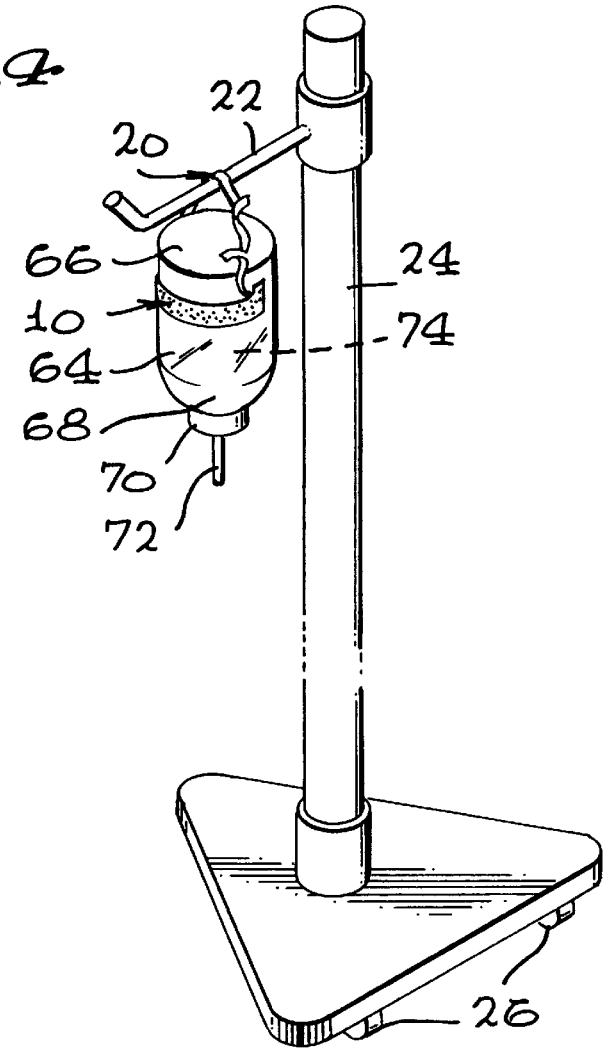
FIG. 4 shows a bottle suspended from a bracket, the bottle having applied thereto a label shown in FIG. 1, with the handle thereof unfolded.

The label 10 is attached to the bottle (before any unfolding of the hanging strip 20) approximately as shown in FIG. 4 of the drawings. The pull tab 36 faces towards base 66 of the glass bottle 64. The glass bottle 64 has an upper end 68 and outlet orifice 70, which attaches to a tube 72. The tube 72, with a needle (not shown) attached at its opposite end, attaches to the patient. By gravity, the contents 74 of the glass bottle 64 are fed through the tube 72 to the patient.

Once the label 10 has been applied to the bottle 64, various items information or additional information can be written on to the label 10 over the information portion 16. Prior or existing printed information may comprise the nature of the contents of the bottle, the amount thereof, and other relevant medical information, while other portions of the information portion 16 may be specially adapted to have written thereon circumstance-specific information, such as patient name, date, and the like. It will appreciated that the information portion 16 provides a relatively large area for use, such area being untouched or unaffected by any cuts which comprise the hanging strip 20. Thus, a particular advantage of arrangement of the present invention is to provide a large information portion 16 upon which information can be written, and none of the information will be removed or moved by the subsequent opening of the hanging strip 20.

In the construction and manufacture of the label 10, adhesive between the label 10 and the liner 38 is inactivated, or partially inactivated, by the application of a deadening composition. The effect of this application on the deadening composition will be to facilitate fairly easy removal of the hanging strip portion 18 from the liner 38. Additionally, when the label 10 is applied to the bottle, the lower surface 14 of the label 10 in the area of the hanging strip portion 18 will have an adhesive which has been partially or completely inactivated. This facilitates removal of the hanging strip 20 from the bottle and the unfolding of the hanging strip 20 avoiding the inconvenience or time intensive task of carefully unfolding the hanging strip 20 to prevent its tearing.

When the glass bottle 64, with contents, is ready for use, the bottle is held in one hand, and, with the thumb and index finger of the other, the pull tab 36 is pulled away from the glass bottle 64. With reference to FIG. 2 of the drawings, there is shown an intermediate position of the hanging strip 20, when it is being unfolded from the completely folded position shown in FIG. 1, but before it has reached the completely unfolded position as shown in FIG. 3. The user continues to pull the pull tab 36 until the hanging strip portion is completely unfolded, as shown in FIG. 3, where it forms a more or less inverted V-shaped portion having an apex 76. This apex 76 is suspended over bracket 22 of the vertical support post 24 and will hold the glass bottle in an inverted position to permit discharge of the contents 74 through the tube 72 to the patient.

As described above, the ends 56 of the various cuts are curved. These curved ends 56 have the effect of strengthening the connection between the hanging strip 20 and the remainder of the label 10, when in the unfolded position and when supporting the weight of the bottle 64 and contents 74. The curved ends 56 prevent tearing of the hanging strip 20 from the remainder of the label by spreading the load, providing a solid base capable of supporting a load well within the range constituted by the weight of the glass bottle 64 and its contents 74.

One advantage of the particular configuration of the hanging strip 20 when in the folded position is that the various cuts of the hanging strip are substantially symmetrical about the pull tab 36. Thus, the gentle pulling of the pull tab 36 in a direction away from the information portion 16 will result in the simple unfolding of equally configured strips on each side of the pull tab 36.

Figure 5:
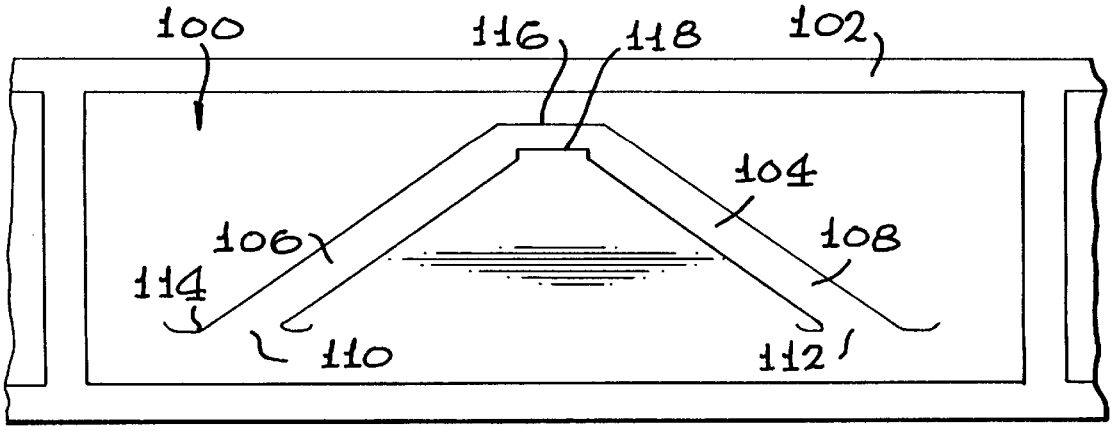
FIG. 5 is a plan view of a second embodiment of a label of the invention showing a V-shaped handle with a notch therein.

Reference is now made to FIGS. 5 and 6 of the accompanying drawings, which show another embodiment of the label of the invention. In FIG. 5, there is shown a label 100 having substantially the same layers as that described above, and mounted on a backing liner 102, as described with respect to FIGS. 1–4 of the drawings. However, in this particular embodiment, hanging strips 104 have a different configuration. As shown in FIG. 5, the hanging strip 104 comprises an inverted V-shaped design. The hanging strip 104 has a first strip 106 and a second strip 108 which, at their bases 110 and 112 respectively join with the remainder of the label, having curved ends 114, which serve the same function of strengthening the hanging strip 104, as described above.

The hanging strip 104 ends at an apex 116, and on the inside thereof there is located a notch 118.

In use, the adhesive below the hanging strip 104 has been inactivated using a deadening composition, as described with respect to FIGS. 1–4, and, when on the bottle, the label 100 can have easily peeled therefrom the hanging strip 104. The label 100 is placed on a bottle, in a manner as described above, with the bases 110 and 112 located at approximately diametrically opposed locations on the bottle. Upon unpeeling of the hanging strip 104, it will be removed from the remainder of the label, as illustrated in FIG. 6.

The hanging strip 104 as illustrated in FIG. 5 and 6 has certain clear advantages. First, the V-shaped configuration of the hanging strip 104 facilitates centering of the hanging strip 104 with respect to a bracket 22. Thus, upon hanging a glass bottle 64 in an inverted position, the V-shaped structure of the hanging strip 104 will be such that the bracket 22 tends to move towards the apex 116. The bracket 22 in fact becomes located within the notch 118 at the apex 116. Thus, not only does the V-shaped hanging strip 104 provide a centering effect, but once the hanging strip 104 has been centered with respect to the bracket 22, the locking action of the notch 118 over the bracket 22 tends to keep the hanging strip 104 stable and less likely to be moved with respect to the bracket. As a consequence, the glass bottle 64 will, of course, hang in a centered and reasonably well fixed inverted position.

FIGS. 7 and 8 show a further variation of the label 100 in FIGS. 5 and 6. These FIGS. 7 and 8 show a label 120, which, instead of having a straight V-shaped structure, has a "dog leg" shape. The hanging strip 122 comprises a first strip 124 and a second strip 126. The first strip 124 has a first portion 128, and a second portion 130 which is approximately at right angles to the first portion. The second strip 126 has a first portion 132 and a second portion 134 of the same shape, but a mirror image of, the first strip 124. The strips 124 and 126 meet at a top end and have a horizontal portion 136 of a short length. The inner side of the horizontal portion has a notch 138.

FIG. 8 shows the hanging label 120 of FIG. 7, but with the hanging strip 122 moved or peeled back into the unfolded or hanging position. One of the advantages of the hanging strip configuration 122 as shown in FIG. 7 and 8 is that the "dog leg" shape assists when moving the hanging strip 122 over the end of the bottle. Since the bases of the first and second strips 124 and 126 are located on the label such that they are in approximately diametrically opposed positions when on the glass bottle, the outer points 140 and 142 will typically have a diameter greater than the bottle, and thus move over the end of the bottle more easily, thus reducing the chances of the hanging strip 122 becoming snagged over the base 66 of the bottle during unfolding from the label.

Figure 9A:
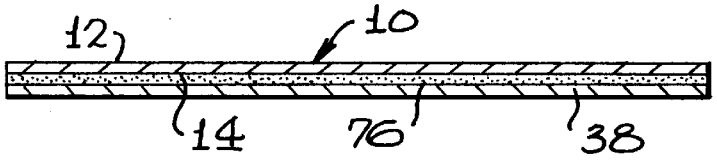
FIG. 9*a* is a diagrammatic cross section through line A—A of FIG. 1.

With reference to FIG. 9*a* there is shown a cross section through line A—A of FIG. 1 indicating the various layers of the label 10, shown in FIGS. 1–3. The bottom layer 38 comprises the liner, and the top layer is the portion which will be the label 10. Intermediate the label 10 and liner 38 is an adhesive layer 76 which is applied to the lower surface 14 of the label 10. The upper surface 12 of the label 10 has, of course, medical information and other identifying material as necessary under the circumstances. Information printed thereon may be preprinted at the time of manufacturing the label, and/or written on by hospital or other medical staff.

Figure 9B:
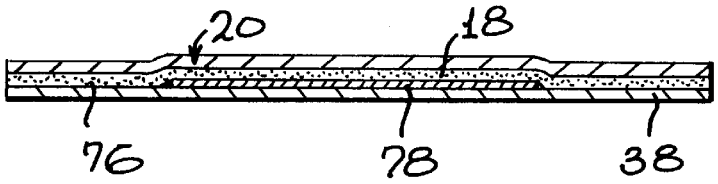
FIG. 9*b* is a diagrammatic cross section through line B—B of FIG. 1.

FIG. 9*b* shows a cross section through FIG. 1 through line B—B. This is substantially identical with FIG. 9*a,* with the exception that the figure shows the inclusion of a deadening layers or varnish 78 between the handle portion 18 of the label 10 and adhesive layer 76. The deadening layer 78 facilitates easy removal and unfolding of the handle portion 18 into the hanging strip 20 by permitting the handle portion 18 to be easily removed from the liner 38 without significant resistance due to the presence of an adhesive layer.

Figure 10:
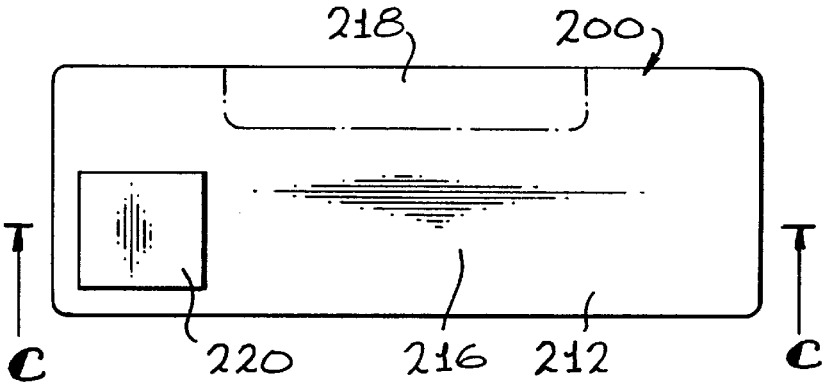
FIG. 10 is a plan view of another embodiment of a label of the invention including a piggyback label thereon.

With reference to FIG. 10 of the drawings, there is shown a further embodiment of a label 200 of the invention. The label 200 may include a handle portion 218 including the cut out of a hanging strip, in a manner similar to that described with reference to FIG. 1.

The upper surface 212 of the label 200 includes an information area 216. Additionally, the label 200 includes a further piggyback label 220 placed on the information portion 216 of the label 200. In use, the piggyback label 220 can be removed from the label 200, and placed on, for example, a patient's chart or on other records.

Figure 11:
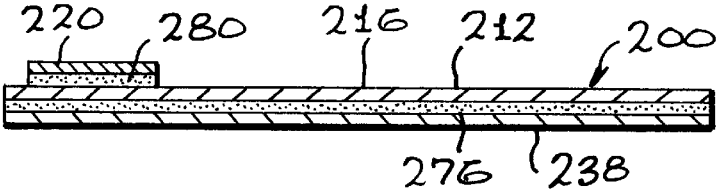
FIG. 11 is a diagrammatic cross section through C—C in FIG. 10.

FIG. 11 shows a cross section through line C—C of FIG. 10. The label 200 is mounted on a liner 238, and has an adhesive layer 276 to permit the label 200 to be attached to a bottle or other receptacle. On the upper surface 212 of the label 200 a release coat 280 is applied, and the piggyback label 220 is located over the release coat 280. This release coat 280 facilitates easy removal of the piggyback label 220 from the remainder of the label 200.

The label shown in FIGS. 10 and 11 is manufactured by first removing or stripping backing paper off a facestock. A deadening varnish is then applied to the area of the adhesive where the hanging strip 20 will be cut. The hanging strip 20 may be the one shown in FIG. 1, or may assume the shape of those illustrated in other embodiments. Once the deadening coating or varnish has been applied, the backing paper is relaminated to the facestock, and the stock is turned over for face printing for what will be the primary label. Thus, identifying and other medical information, as appropriate, will be printed on the face of the primary label. Once this has been completed, a coating of release varnish, typically a UV release coat, is applied. Thereafter, a second facestock is laminated to the existing facestock, and a dye cut of he second facestock only takes place, corresponding to the shape of the piggyback label 220. Thereafter, the unused stock of the second facestock is removed, leaving only the piggyback label 220. Thus, the printing introduced on to the facestock of the primary label will once more be visible. At this time, additional printing, as appropriate, will take place on the piggyback label, although the printing can take place at various times. Thus, the printing may have been introduced prior to lamination of the second stock face to the existing stock face. The label is thereafter treated by cutting the hanging strip 20 in the facestock, namely, into the main body of the label. Thereafter, there is a rewinding on to a roll and the labels produced by this process are now ready for further processing. This would include the eventual application of the label on to the bottle or receptacle for use in a medical setting.

Figure 12:
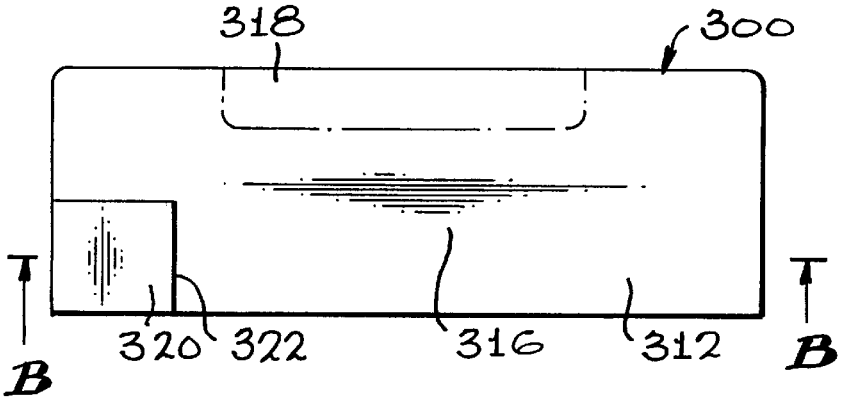
FIG. 12 is a plan view of another embodiment of a label of the invention including a peel-off section.
Figure 13:
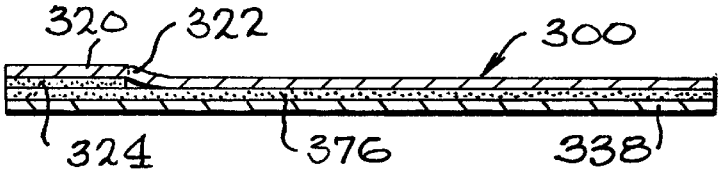
FIG. 13 is a cross section through line BB of FIG. 12.

Reference is now made to FIG. 12 of the drawings, which shows a label 300, including an upper surface 312 and information portion 316 and a handle portion 318. The label shown in this embodiment is somewhat similar to that shown in FIG. 10 except that the piggyback label is now in the form of a peel-off label 320. The peel-off label is comprised of the same stock as the remainder of the label 300, but is a treated section for easy removal. The peel-off label is surrounded by a cut 322. A deadening coat 324, shown in FIG. 13 of the drawings, is introduced between the adhesive layer 376 and the remainder of the label 300. It will be noted that this deadening coat 324 is introduced only between those portions of the label 300 and adhesive 376 at which the peel-off label 320 is located.

The peel-off label offers a similar function to the piggyback label 220 as shown in FIGS. 10 and 11. Thus, the peel-off label 320 may include information which can be placed into a patient's chart, or other hospital or health record, so as to provide a readily available source of information in the records.

The invention is not limited to the precise constructional details of the invention as illustrated and described above.

I claim:

1. A label comprising:

an upper surface;

a lower surface having an adhesive layer thereon to permit adherence of the label to a surface;

a handle portion having thereon a substantially centrally located pull tab and a series of cuts which permit unfolding of the handle portion into a hanging strip, the cuts defining a top strip near an upper edge of the label, a pair of middle strips extending outwardly from a substantially central portion of the handle portion, and a pair of lower strips extending outwardly from the substantially central portion of the handle portion, the cuts being arranged such that the handle portion unfolds along the cuts when the pull tab is pulled, the handle portion having a deadening layer on the adhesive layer thereof.

2. A label as claimed in claim 1 wherein the pull tab comprises a rounded projection extending from an upper edge of the handle portion.

3. A label as claimed in claim 1 wherein the top strip and middle strip are separated by an upper transverse cut, the middle strip and lower strip are separated by a pair of median cuts therebetween, and the lower strip is separated from the remainder of the label by a lower transverse cut.

4. A label as claimed in claim 3, wherein the upper and lower transverse cuts terminate at ends which are curved, and an end of each medium cut terminating within the handle portion has a curved end.

5. A label as claimed in claim 2 further comprising a plurality of ties along one or more of the cuts, the ties being easily ruptured upon unfolding of the handle portion.

6. A label as claimed in claim 1 further comprising an information portion, adjacent the handle portion, upon which printed or written information is entered.

7. A label as claimed in claim 1 wherein the information portion includes a peel-off section, the peel-off section being defined by vertical and horizontal cuts on the information portion, the label further comprising a release layer on the face layer of the peel-off section to permit easy removal thereof.

8. A label as claimed in claim 1 further comprising a piggyback label on an information portion of the label, the piggyback label being easily removable from the information portion of the label.

9. A label as claimed in claim 1, further comprising a liner upon which the label is mounted, the label including an adhesive layer thereof on the lower surface being removable from the liner for application, in use, to a container or receptacle.

10. A label comprising an upper surface, a lower surface having an adhesive layer thereon to permit adherence of the label to a surface, a handle portion having thereon a series of cuts which define a substantially V-shaped handle portion, the V-shaped handle portion being folded on the label, and movable to an unfolded position so as to define a hanging strip, the handle portion having a deadening layer on the adhesive layer, the cuts defining a top strip near an upper edge of the label, a pair of middle strips extending outwardly from a substantially central portion of the handle portion, and a pair of lower strips extending outwardly from the substantially central portion of the handle portion.

11. A handle is claimed in claim 10 wherein the V-shaped handle portion has a notch at its apex, the notch being adapted to engage a holding bracket to prevent slippage of the hanging strip on said bracket.

12. A handle is claimed in claim 10 wherein the V-shaped handle portion comprises a pair of arms, each arm having a base, the bases being spaced from each other on the label such that the distance therebetween approximates half of the diameter of a bottle or receptacle to which the label may be attached.

13. A label as claimed in claim 10 further comprising an information portion and a piggyback label on the information portion, the piggyback label being easily removable from the information portion.

14. A label as claimed in claim 10, further including an information portion, and a peel-off section on the information portion, the peel-off section being easily removable from the information portion.

15. A process for manufacturing a label including a first base label and a piggyback label thereon, the method comprising:

forming a handle portion on the base label;

applying a deadening label between an adhesive on a lower surface of the base label and the handle portion to permit easy unfolding of the handle portion into a hanging strip;

applying a release layer to an upper surface of the label;

laminating a piggyback label on the release coating;

cutting through the piggyback label to provide such a piggyback label of desired shape;

forming a notch at an apex of the handle portion, the notch being adapted to engage a holding bracket to prevent slippage on the bracket; and removing those portions of the piggyback label outside the cut so as to provide a small piggyback label thereon.

16. A label comprising:

an upper surface;

a lower surface having an adhesive layer thereon to permit adherence of the label to a surface;

a handle portion having thereon a substantially centrally located pull tab with a rounded projection extending from an upper edge of the handle portion, and a series of cuts which permit unfolding of the handle portion into a hanging strip, the cuts being arranged such that the handle portion unfolds along the cuts when the pull tab is pulled, the handle portion having a deadening layer on the adhesive layer thereof, and a plurality of ties along one or more of the cuts, the ties being easily ruptured upon folding of the handle portion.

17. A label comprising an upper surface, a lower surface having an adhesive layer thereon to permit adherence of the label to a surface, a handle portion having thereon a series of cuts which define a substantially V-shaped handle portion, the V-shaped handle portion being folded on the label, and movable to an unfolded position so as to define a hanging strip, the handle portion having a deadening layer on the adhesive layer, the V-shaped handle portion having a notch at its apex adapted to engage a holding bracket to prevent slippage of the hanging strip on said bracket.

* * * * *